United States Patent [19]

Tudek

[11] Patent Number: 4,991,634

[45] Date of Patent: Feb. 12, 1991

[54] MOTOR OIL FILLER CAP ASSEMBLY

[76] Inventor: Arthur L. Tudek, 507 Indiana Ave., Glassport, Pa. 15045

[21] Appl. No.: 389,103

[22] Filed: Aug. 3, 1989

[51] Int. Cl.[5] ..... F01M 11/04

[52] U.S. Cl. ..... 141/330; 141/98; 222/81; 184/1.5; 184/105.1; 7/100

[58] Field of Search ..... 141/98, 329, 330; 222/81, 88; 7/100; 184/1.5, 105.1

[56] References Cited

U.S. PATENT DOCUMENTS

| | | | |
|---|---|---|---|
| 1,427,545 | 8/1922 | Orr | 141/330 |
| 1,488,377 | 3/1924 | Carrau | 141/330 |
| 1,912,283 | 5/1933 | Kronquest | 222/88 |
| 2,017,818 | 10/1935 | Reynolds | 141/330 |
| 2,099,324 | 11/1937 | Wiswell | 141/364 X |
| 2,693,249 | 11/1954 | Baumbach | 141/330 |
| 3,115,908 | 12/1963 | Carlson et al. | 141/330 |
| 3,331,405 | 7/1967 | Gaudet | 141/330 |
| 3,934,623 | 1/1976 | Hays | 141/330 X |
| 4,289,255 | 9/1981 | Strampe | 222/81 |
| 4,497,351 | 2/1985 | Garcia | 141/329 |
| 4,739,861 | 4/1988 | Desjardins | 184/1.5 |

*Primary Examiner*—Ernest G. Cusick
*Assistant Examiner*—Casey Jacyna
*Attorney, Agent, or Firm*—William J. Ruano

[57] ABSTRACT

A replacement assembly for an oil filler cap for motor vehicles. The assembly includes a spring tensioned lid and a cylindrical tube having a downwardly taped lower portion surrounded by washer means and a pair of holes on diametrically opposite sides of the inwardly tapered lower portion of the tube. The cutter blade has an upwardly extended pointed end in spaced relationship to the inner wall of the tube and has a pair of downwardly extending, diametrically opposite flexible strips, each having an ear terminating with a semi-circular flat portion projecting outwardly through the holes for supporting the washer means.

4 Claims, 1 Drawing Sheet

MOTOR OIL FILLER CAP ASSEMBLY

BACKGROUND OF THE INVENTION

This invention was conceived to make it easier for motorists to pour oil into their vehicles and preventing spillage and unwanted substances on and in their engines. With the advent of self-service stations, motorists must personally pour the oil. This presents a problem. Manufacturers of oil containers have designed containers with long necks or spouts to make it easier to pour but overlooked the fact that spillage will occur when the container is opened and tilted so that its opening is moved to the inlet of the oil reservoir. Because of tight quarters or even when clearance exist, during the course of the tilt of a full container, spillage often occurs before the spout is secure in the inlet of the reservoir.

The second problem with the standard oil filler cap is it is removed by hand and placed somewhere. This has two drawbacks. The first, the user can forget to replace the cap thus creating an oil splashing problem while driving.

SUMMARY OF THE INVENTION

An object of the present invention is to provide an oil cap assembly to replace the conventional, standard oil filler caps which overcomes the above-mentioned problems and to merit other advantages.

The principal object of the invention is to provide a replacement oil filler cap assembly comprising the body, sometimes referred to as a spout. It is a short tube or pipe, tapered at the bottom to fit when placed into the opening of the valve cover of a motor and it houses the following parts:

A spring tensioned lid to close securely when at rest. This insures from misplacing or forgetting to replace the cover.

A container opener or cutter blade enveloping the inner walls of the body or spout to open oil containers with necks by merely opening the hinged lid and placing the capped container with the neck into opening of the spout and pressing down on the container to break the seal, thus resulting in oil flow into the reservoir without spillage.

A securer for the blade-retaining clip assembly, consisting of a nut, bolt, rubber washer and a spacer. The nut and bolt is self-explanatory. The rubber washer prevents oil from leaking out of this hole and the spacer holds the blade away from the wall of the body to get a good bite and break the seal of the container.

Two retainer clips that is an extension of the cutter blade to hold the assembly securely into the valve cover opening. At the ends of the retainer clips are half-round lug ears. They fit into the holes of the body located on each side at the tapered end and protrude to the outer walls. The reason for the lug ears, being round on the bottom and with the spring tension of the clips, they can slide and give way to fit into the valve cover opening. The lug ears being flat on the top, locks the unit into the cover of the motor because of the spring tensioned clips pressuring them shut.

A hard washer situated at the outer side of the body below the taper to act as a backboard for a soft washer to seal the valve cover hole.

A screen filter at the bottom of the assembly to keep foreign substances from getting into the system.

DETAILED DESCRIPTION OF PREFERRED EMBODIMENTS

Figure 1:
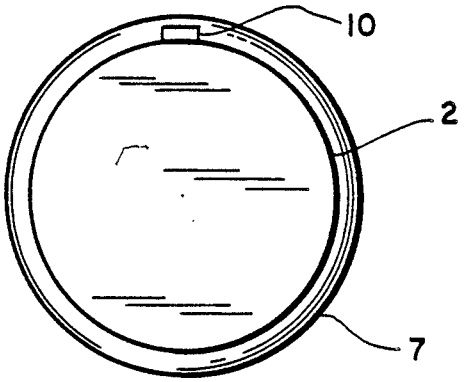
FIG. 1 shows a top view of the oil filler cap embodying the present invention.
Figure 2:
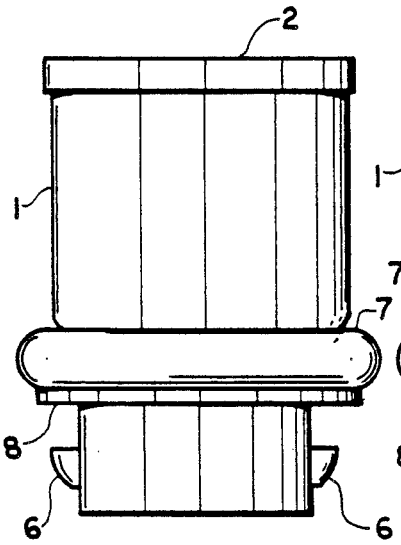
FIG. 2 is a rear view of the assembly.
Figure 3:
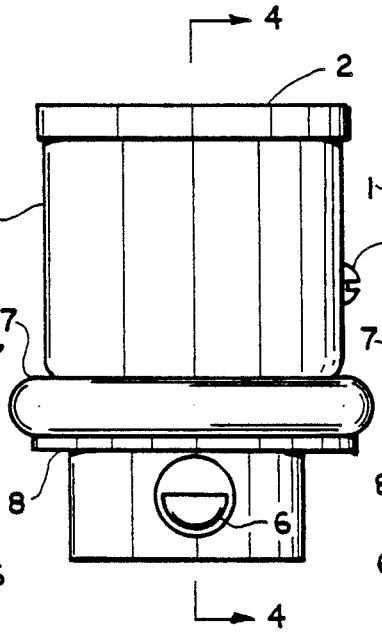
FIG. 3 is a side view thereof.

Referring more particularly the drawings in FIG. 2 number 1 denotes the body or spout, a short tube or pipe of any construction, preferably of metal, the lower end of which is tapered with two holes on both sides to house the lug ears of the retaining clips to fit into the valve cover of an internal combustion engine. The cap 2 has a spring tensioned hinge 10 to close tightly when let go. Enveloping and attached to the inner walls of the body 1 by means of a blade-clip securer 3 (partially shown), consisting of a bolt, rubber washer, spacer and a nut is the cutter blade 4, a curved, pointed, triangular shaped insert having two long, narrow strips known as retaining clips 5 having half round lug ears 6 to fit into the holes of body 1 and protruding said walls to act as a lock for the assembly. Above the lug ears 6 and below the bevel on the outer side of body 1 is a round hard washer 7 to function as a pressure plate for the soft washer 8 to seal the valve cover opening. At the extreme end of body 1 is a screen filter 9 to filter out foreign matter.

Figure 4:
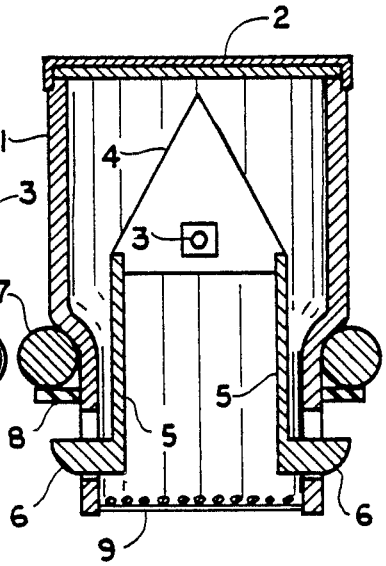
FIG. 4 is a cross-sectional view taken along line 4—4 of FIG. 3.
Figure 5:
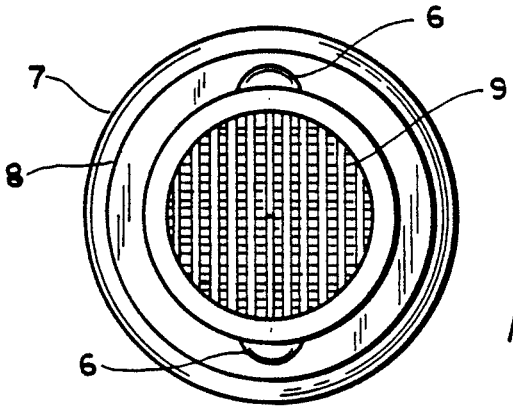
FIG. 5 is a bottom view thereof.

FIG. 4 shows the cutter blade-retaining clip assembly 4, 5 and 6 of which 4 is the cutter blade, 5 are the retaining clips and 6 is the lug ears, in which this assembly is a single construction press-out.

While a preferred embodiment of an oil filler cap assembly with a spring tensioned hinged cap, container opener, spout and filter is herein shown and described, it is to be understood that various changes and improvements may be made therein without departing from the scope and spirit of the appended claims.

What I claim:

1. An assembly for insertion into an oil receiving tube of a motor vehicle comprising a cylindrical tube having a hinged cap, a top and a bottom and having an inwardly and downwardly tapered lower portion surrounded by washer means adapted for sealingly connecting said cylindrical tube to said oil receiving tube, a pair of holes on diametrically opposite sides of said downwardly tapered lower portion, a cutter blade mounted on the interior of said tube with a pointed end thereof extending upwardly in spaced relationship to the inner wall of said cylindrical tube, said cutter blade having a pair of downwardly extending, diametrically opposite flexible strips, each having an extension adapted to project radially outwardly through said holes, and a disc shaped screen filter extending across the bottom of said tube.

2. A replacement assembly as recited in claim 1 wherein said hinged cap has spring means for biasing it in the closed position.

3. A replacement assembly as recited in claim 2 wherein each of said extensions is semi-circular with a flat portion extending horizontally, downwardly of said strips.

4. A replacement assembly as recited in claim 2 wherein said washer means includes a hard upper washer and a soft lower washer for forming a seal with the oil receiving tube of a vehicle.

* * * * *